US009062410B2

(12) United States Patent
Ahn et al.

(10) Patent No.: US 9,062,410 B2
(45) Date of Patent: Jun. 23, 2015

(54) DRYER AND FOREIGN MATERIAL REMOVING APPARATUS THEREOF

(75) Inventors: Seung-Phyo Ahn, Changwon-si (KR); Jeong-Yun Kim, Changwon-si (KR); Sang-Ik Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 920 days.

(21) Appl. No.: 13/131,578

(22) PCT Filed: Dec. 16, 2009

(86) PCT No.: PCT/KR2009/007528
§ 371 (c)(1),
(2), (4) Date: May 26, 2011

(87) PCT Pub. No.: WO2010/071355
PCT Pub. Date: Jun. 24, 2010

(65) Prior Publication Data

US 2011/0225837 A1 Sep. 22, 2011

(30) Foreign Application Priority Data

Dec. 17, 2008 (KR) ..... 10-2008-0128606
Dec. 22, 2008 (KR) ..... 10-2008-0130803

(51) Int. Cl.
*F26B 21/06* (2006.01)
*D06F 58/22* (2006.01)
*D06F 58/04* (2006.01)

(52) U.S. Cl.
CPC ..... *D06F 58/22* (2013.01); *D06F 58/04* (2013.01)

(58) Field of Classification Search
CPC ..... D06F 58/22; D06F 58/04; D06F 58/20; D06F 58/24; F26B 25/007; F26B 21/003; B23Q 9/0014
USPC ..... 34/82, 480, 218, 85, 235, 300, 667, 34/139; 15/88.4
See application file for complete search history.

(56) References Cited

U.S. PATENT DOCUMENTS

| | | | | |
|---|---|---|---|---|
| 2,096,915 | A * | 10/1937 | Polgar | 15/88.4 |
| 2007/0256317 | A1* | 11/2007 | Johnson | 34/82 |
| 2008/0196268 | A1 | 8/2008 | Jung et al. | |
| 2009/0031513 | A1* | 2/2009 | Goldberg et al. | 15/88.4 |
| 2009/0158933 | A1 | 6/2009 | Schaub | |

FOREIGN PATENT DOCUMENTS

| | | | | |
|---|---|---|---|---|
| CN | 1766209 | A | 5/2006 | |
| CN | 101311407 | A | 11/2008 | |
| CN | 102257208 | A | 11/2011 | |
| DE | 8224528 | U1 * | 2/1983 | D06F 58/22 |
| DE | 3817849 | A1 | 12/1989 | |

(Continued)

*Primary Examiner* — Kenneth Rinehart
*Assistant Examiner* — Bao D Nguyen
(74) *Attorney, Agent, or Firm* — McKenna Long & Aldridge LLP

(57) ABSTRACT

The embodiment proposes a foreign material removing apparatus for a dryer. The foreign material removing apparatus for a dryer according to an embodiment of the present invention includes: a case including an air introduction hole into which air discharged from a drum is introduced, an air discharge hole, and a foreign material discharge hole; a filtering unit that is provided in the case and includes a filter; and a cleaning unit that moves relatively to the filter and has one or more cleaning devices for removing the foreign materials accumulated in the filter.

9 Claims, 8 Drawing Sheets

(56) References Cited

FOREIGN PATENT DOCUMENTS

| | | | |
|---|---|---|---|
| DE | 102005055179 | A1 | 5/2007 |
| DE | 102006060031 | A1 | 6/2008 |
| JP | 07-000694 | A | 1/1995 |
| JP | 2001-276494 | A | 10/2001 |
| JP | 2002-200395 | A | 7/2002 |
| KR | 20-1996-0015139 | U | 5/1996 |
| KR | 10-2004-0056809 | A | 7/2004 |
| KR | 10-2007-0075596 | A | 7/2007 |
| KR | 10-0956812 | B1 | 5/2010 |
| TW | 299377 | | 3/1997 |

* cited by examiner

DRYER AND FOREIGN MATERIAL REMOVING APPARATUS THEREOF

This application is a National Stage Entry of International Application No. PCT/KR2009/007528, filed Dec. 16, 2009, and claims the benefit of Korean Patent Application Nos. 10-2008-0128606, filed on Dec. 17, 2008 and 10-2008-0130803, filed on Dec. 22, 2008, which are hereby incorporated by reference for all purposes as if fully set forth herein.

TECHNICAL FIELD

The embodiment relates to a dryer and a foreign material removing apparatus thereof.

BACKGROUND ART

In general, a dryer is an apparatus that dries a dry target by blowing hot wind generated by a heater into a rotary drum to absorb moisture of a drying target (i.e., clothes which has been washed).

The dryer is largely classified into an exhaust type dryer and a condensation type driver in accordance with a processing scheme of moisture containing wet air generated by drying the drying target.

More specifically, the exhaust-type dryer discharges the wet air discharged from the drum to the outside of the dryer. Meanwhile, the condensation-type dryer removes the moisture by condensing the wet air discharged from the drum and thereafter, heats a dry air without moisture again and sends it to the drum.

Meanwhile, since the drum rotates in a drying process, the drying target housed in the drum is wound in the drum as the drum rotates. In this process, foreign materials contained in the drying target are spread in the air. Therefore, the foreign materials are included in the air passing through the drum.

The foreign materials contained in the air causes troubles while passing through mechanical components of the dryer. In addition, the foreign materials contained in the air are discharged to the outside of the dryer to injure user's health. Therefore, while the air passing through the drum passes through a filter, the foreign materials should be removed from the air.

In general, the filter is provided at the lower side of the drum and filters the foreign materials contained in the air passing through the drum. When the foreign materials are accumulated in the filter at predetermined levels, circulation of the air is interfered, such that cleaning is required.

In general, the filter is removably coupled to the dryer and after a drying cycle is terminated, the user separates and cleans the filter.

In particular, since the foreign materials which are contained in the wet air contain moisture, the foreign materials are damply attached to the filter. In addition, as the drying cycle is performed, when the amount of the moisture contained in the air decreases, the damply wet foreign materials adhere to the filter while being dried. Therefore, it is difficult to clean the filter.

If the state where the foreign materials adhere to the filter is ignored, proper wind quantity is not secured. As a result, since the air heated by the heater is not cooled, there is a risk of firing.

Since the filter cleaning operation should be performed whenever using the dry in order to secure the wind quantity in the dryer and prevent firing, it is troublesome to the user.

DISCLOSURE OF INVENTION

Technical Problem

An object of the present invention is to provide a dryer in which a filter is automatically cleaned and a foreign material removing apparatus thereof.

Solution to Problem

A foreign material removing apparatus for a dryer according to an embodiment of the present invention includes: a case including an air introduction hole into which air discharged from a drum is introduced, an air discharge hole, and a foreign material discharge hole; a filtering unit that is provided in the case and includes a filter; and a cleaning unit that moves relatively to the filter and has one or more cleaning devices for removing the foreign materials accumulated in the filter.

A dryer according to another embodiment of the present invention includes: a cabinet forming an exterior; a drum that is provided in the cabinet and houses a drying target; and a foreign material removing apparatus filtering foreign materials from air discharged from the drum, wherein the foreign material removing apparatus includes a case including an air passage; a filtering unit having a filter disposed on the air passage; and a cleaning device that is movably provided in the case and removes the foreign materials of the filter.

A dryer according to yet another embodiment of the present invention includes: a cabinet forming an exterior; a drum that is provided in the cabinet and houses a drying target; and a foreign material removing apparatus filtering foreign materials from air discharged from the drum, wherein the foreign material removing apparatus includes a case including an air passage; a filtering unit having a filter disposed on the air passage; a cleaning device for removing the foreign materials of the filter; and a foreign material case containing the foreign materials from the filter, wherein the cleaning device is in contact with the filter and the foreign materials of the filter are separated from the filter by friction generated due to relative movement of the cleaning device and the filter.

Advantageous Effects of Invention

According to an embodiment of the present invention, since foreign materials that adhere to a filter are automatically removed, it is possible to give a high-class image for a product and increase user satisfaction.

Further, since a user just separates a foreign material case to remove the foreign materials when foreign materials are stored in the foreign material case at predetermined level, the user just removes the foreign materials without cleaning the filter whenever using the dryer, user convenience is maximized.

Further, in the case where the filter is automatically cleaned, wind quantity passing through the inside of the drum is maintained at predetermined level or more, thereby minimizing a risk of firing.

MODE FOR THE INVENTION

Hereinafter, embodiments will be described in detail with reference to the accompanying drawings.

Figure 1:
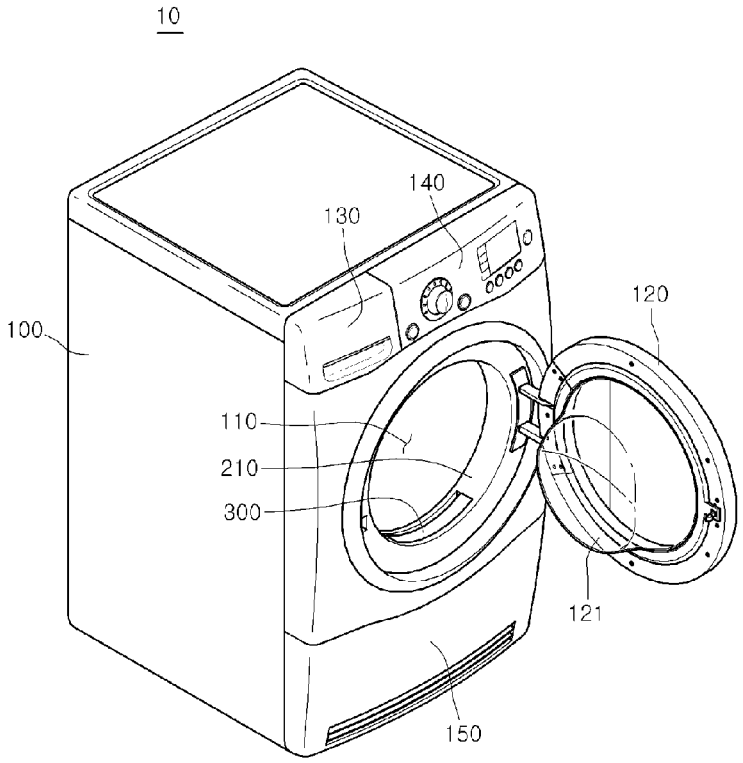
FIG. 1 is a perspective view showing an exterior of a dryer according to a first embodiment.
Figure 2:
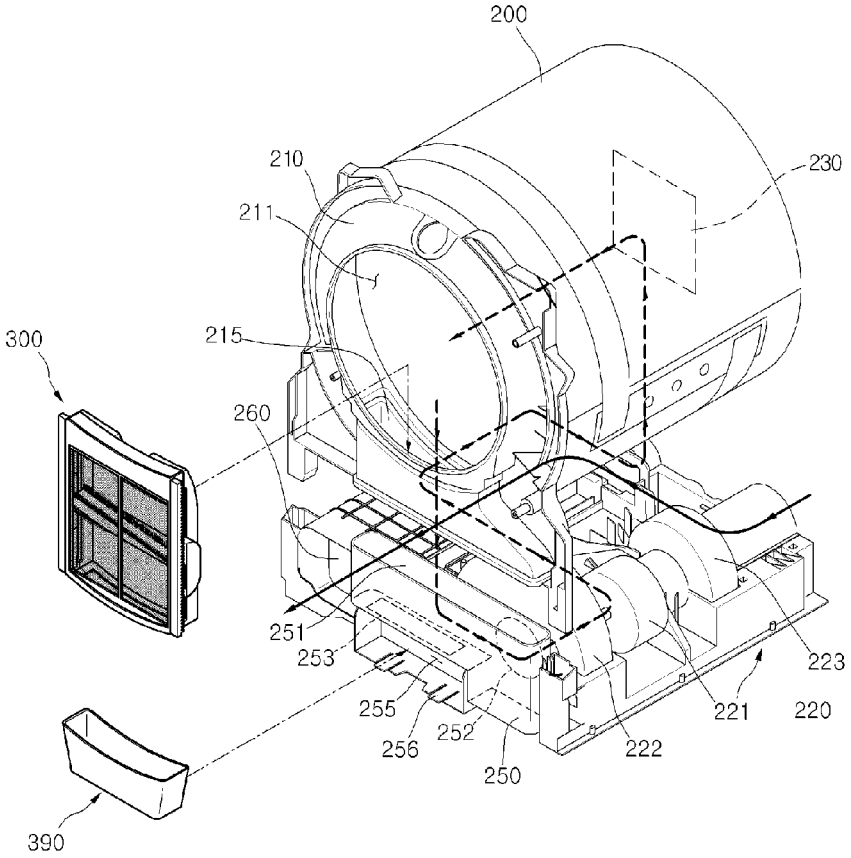
FIG. 2 is an exploded perspective view showing main internal components of a dryer according to an embodiment of the present invention.

FIG. 1 is a perspective view showing an exterior of a dryer according to a first embodiment and FIG. 2 is an exploded perspective view showing main internal components of a dryer according to an embodiment of the present invention.

Hereinafter, although a condensation-type dryer is described as one example, the spirit of the embodiments is not limited to the condensation-type dryer and is applicable even to an exhaust-type dryer.

Referring to FIGS. 1 and 2, the dryer 10 according to the first embodiment of the present invention includes a cabinet 100 forming an exterior thereof and having an opening part 110 formed on a front surface thereof and a door 120 that is rotatably connected to one side of the cabinet 100, and opens and closes the opening part 110.

A drum 200 is provided in the cabinet 100, which houses a large quantity of moisture containing drying target, such as clothes inputted through the opening part of the cabinet 100.

In addition, a transparent window 121 is formed in the door 120 so as to view the inside of the drum 200 with the door 120 closed.

A control unit 140 that can control an operation of the dryer 10 is provided at one side of the cabinet 100. A display and a plurality of buttons are provided in the control unit 140 for a user to select his/her desired drying cycle and view an operation process.

In addition, a drawer 130 collecting condensed water generated while drying the drying target is provided in the cabinet 100. The user can waste the condensed water by separating the drawer 130 from the cabinet.

A lower cover 150 is removably provided in a front lower portion of the cabinet 100. The lower cover 150 covers a heat exchanger 260 cooling air that circulates in the dryer 10. The user separates the lower cover 150 from the cabinet 100 and thereafter, draws out the heat exchanger 260 to the outside of the cabinet 100 for cleaning.

Meanwhile, a foreign material removing apparatus 300 removing the foreign materials contained in the air passing through the drum 200 is provided in front of the drum 200.

Hereinafter, internal components of the dryer 10 will be described in detail.

Referring to FIGS. 1 and 2, the cabinet 100 includes the drum 200 housing the drying target, a drum cover 210 that is coupled to the front surface of the drum 200 to support the drum 200, a motor 221 that is provided in a lower portion of the drum 200 to rotate the drum 200, and a base 220 including a circulation fan 222 that is connected to the motor 221 to move the air in the drum 200.

More specifically, the drum 200 has a cylindrical shape of which at least a front surface is opened. The opened front surface of the drum 200 faces the opening part 110. The front surface of the drum 200 is rotatably connected to the drum cover 210. A felt is provided in the drum cover 210 that is in contact with the drum 200 to allow the drum 200 to smoothly rotate.

The drum cover 210 supports the drum 200 and is mounted in an upper portion of the base 220. The drum cover 210 includes an input hole 211 that is formed at a portion of the front surface of the drum 200 corresponding to the opening part 110 to allow the drying target to be inputted. That is, when the user opens the door 120 and inputs the drying target through the opening part 110, the drying target is housed in the drum 200 while passing through the input hole 211.

Further, an air duct 215 is formed in a lower portion of the input hole 211 so as to circulate the air passing through the drum 200. The upper and lower portions of the air duct 215 are opened to allow the air to pass through the air duct. The bottom of the air duct 215 is connected to the cover 250 provided in the base 220. In addition, the foreign material removing apparatus 300 is mounted on the air duct 215 to filter the foreign materials.

In addition, the base 220 forms the bottom surface of the dryer 10 and supports the drum cover 210 and the drum 200. More specifically, the motor 221 rotating the drum 200 is provided in the base 220. The motor 221 is connected with the drum 200 through a belt (not shown) to rotate the drum 200.

Further, a circulation fan 222 moving the air in the drum 200 is provided in the base 220. The circulation fan 222 rotates with being connected to the motor 221 and is provided in front of the motor 221.

In addition, a cooling fan 223 that rotates with being connected to the motor 221 and sucks external air is provided behind the motor 221. The external air sucked by the cooling fan 223 absorbs heat while passing through the heat exchanger 260. In addition, a heater 230 that heats the air introduced into the drum 200 is provided in a rear portion of the drum 200.

The heat exchanger 260 that allows the air which circulates in the drum 200 and the air introduced from the outside of the dryer 10 to exchange heat is provided in the base 220. The heat exchanger 260 may be drawn out toward the front of the base 220 for the user to clean the heat exchanger 260.

Further, the cover 250 is removably provided on the front of the base 220. The cover 250 is provided in a direct lower portion of the drum cover 210 and is connected with a lower end portion of the air duct 215.

More specifically, a housing part 251 for housing the foreign material removing apparatus 300 is formed in the cover 250. Therefore, when the foreign material removing apparatus 300 is inserted into and mounted on the air duct 215, a portion of the foreign material removing apparatus 300 is housed in the housing part 251.

In addition, the housing part 251 extends up to the front of the circulation fan 222 and a hole 252 for allow the air to flow is formed at a position corresponding to the circulation fan 222.

Therefore, the air that moves from the drum 200 to the air duct 215 flows in the foreign material removing apparatus 300 and thereafter, moves to the circulation fan 222 through the hole 252.

A mounting part 255 on which a foreign material case 390 is removably mounted is formed at one side of the cover 250. The mounting part 255 is recessed to correspond to the shape of the foreign material case 390 and a hook 256 may be formed on the bottom surface of the mounting part 255 so as to prevent the foreign material case 390 from being easily separated after the foreign material case 390 is coupled to the mounting part 255. The top surface of the foreign material case 390 is opened.

An opening part 253 to allow the foreign materials that drops from the foreign material removing apparatus 300 to be housed in the foreign material case 390 is formed in the cover 250.

More specifically, a foreign material discharge hole is provided on the bottom surface of the foreign material removing apparatus 300 and the opening part 253 is formed at a positioned corresponding to the foreign material discharge hole. Therefore, the foreign materials separated from the foreign material removing apparatus 300 drops to the foreign material case 390 through the foreign material discharge hole and the opening part 253.

Accordingly, when the foreign materials are stored in the foreign material case 390 at predetermined level or more, the user just separates the foreign material case 390 to remove the foreign materials, thereby improving user convenience.

Further, a portion of the foreign material removing apparatus 300 may penetrate the opening part 253. In this case, the foreign materials may be prevented from being leaked to the outside of the foreign material case.

Meanwhile, the foreign material removing apparatus 300 for removing the foreign materials contained in the air passing through the drum 200 is mounted on in the drum 210.

More specifically, since the driving target contains much moisture, when dry hot wind passes through the drying target, the moisture contained in the drying target evaporates and spreads to the air. The process is executed at the same time when the drum 200 rotates. The drying target is dried with being rotated together with the drum 200. At this time, foreign materials such as dust, naps, etc. contained in the drying target spread to the air. When the foreign materials in the air are just introduced into the circulation fan 222, etc. a trouble may be caused. As a result, the foreign materials should be filtered before passing through the circulation fan 222.

Therefore, the foreign material removing apparatus 300 is positioned at the upper side of the circulation fan 222 on the basis of the flow of the air to filter the foreign materials contained in the air passing through the drum 200. More specifically, the foreign material removing apparatus 300 is inserted into and mounted from the upper portion to the lower portion of the air duct 215 and a portion of the foreign material removing apparatus 300 is inserted into the housing part 251 of the cover 250.

At this time, the air is introduced from the upper portion of the foreign material removing apparatus 300 and the air from which the foreign materials are filtered is discharged to the front of the foreign material removing apparatus 300. As a result, the front surface of the foreign material removing apparatus 300 may be spaced from the inner surfaces of the drum cover 210 and the housing part 251 so as to allow the air to smoothly move in the drum cover 210 and the housing 251.

Further, the foreign material removing apparatus 300 has a shape corresponding to the shape of an entrance (upper end portion) of the air duct 215 so as to prevent the foreign materials contained in the air from being accumulated in the air duct 215.

Hereinafter, the flow of the air of the dryer 10 will be described in brief.

Referring to FIG. 2, air (dotted line: hereinafter, referred to as "circulation air") that circulates in the dryer 10 is cooled by air (solid line: referred to as "cooled air") introduced from the outside of the dryer 10.

More specifically, the circulation air in the drum 200 contains a large quantity of moisture containing foreign materials. The circulation air moves forwards on the basis of the drum 200 by rotating the circulation fan 222. That is, the circulation fan 222 generates suction flowing to suck the circulation air toward the circulation fan 222. The circulation air discharged from the drum 200 is filtered with the foreign materials while passing through the foreign material removing apparatus 300 mounted on the air duct 215.

In addition, the circulation air passing through the foreign material removing apparatus 300 moves to the heat exchanger 260 through the circulation fan 222. The circulation air is cooled while being deprived of heat to the cooled air in the heat exchanger 260. At this time, since the circulation air contains the moisture, condensed water is generated during the cooling process. The condensed water moves to be discharged to the drawer 130.

In addition, while the cooled circulation air moves to the rear side of the base 220 and moves on a passage formed in the rear of the drum 200, the cooled circulation air is heated by the heater 230 at high temperature. In addition, the heated air is introduced into the drum 200 from the rear side of the drum 200 to circulate in the dryer 10.

Meanwhile, the cooled air is sucked to the inside of the base 220 from the rear side of the dry 10 by rotating the cooling fan 223. The cooled air moves to the heat exchanger 260 on the passage formed in the base 220 to absorb the heat of the circulation air. Thereafter, the high-temperature cooled air discharged to the front or the side of the dryer 10.

During the process, the foreign materials filtered by the foreign material removing apparatus 300 are automatically separated from a filter (to be described below) and stored in the foreign material case 390.

Hereinafter, detailed components of the foreign material removing apparatus 300 will be described with reference to the accompanying drawings.

Figure 3:
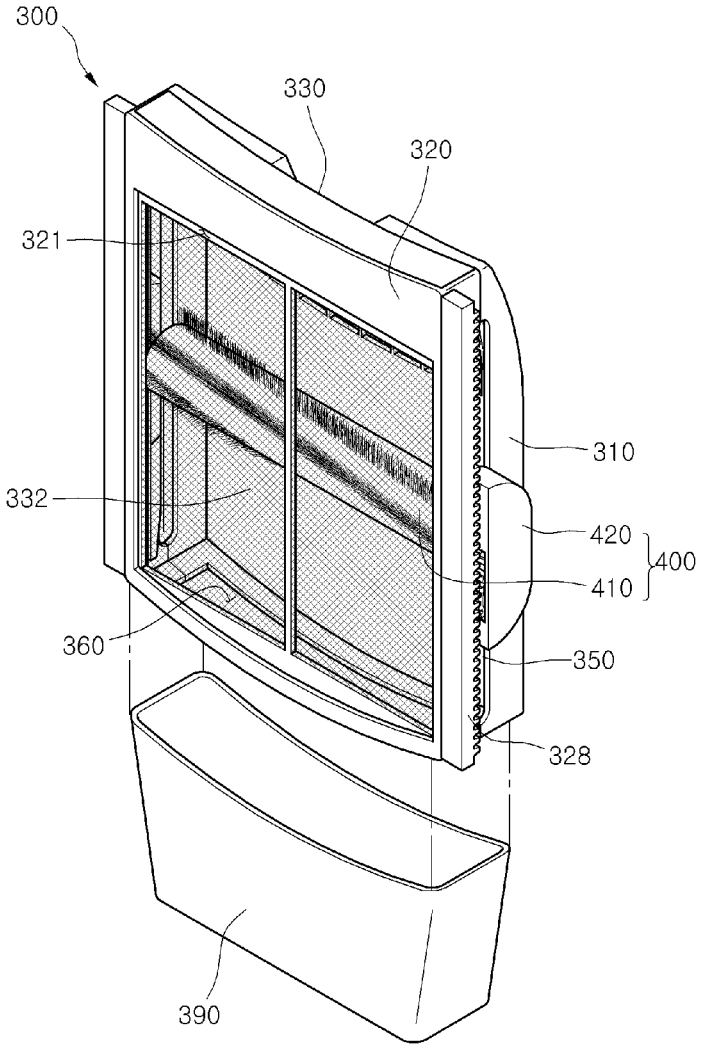
FIG. 3 is a perspective view of a foreign material removing apparatus and a foreign material case according to a first embodiment.
Figure 4:
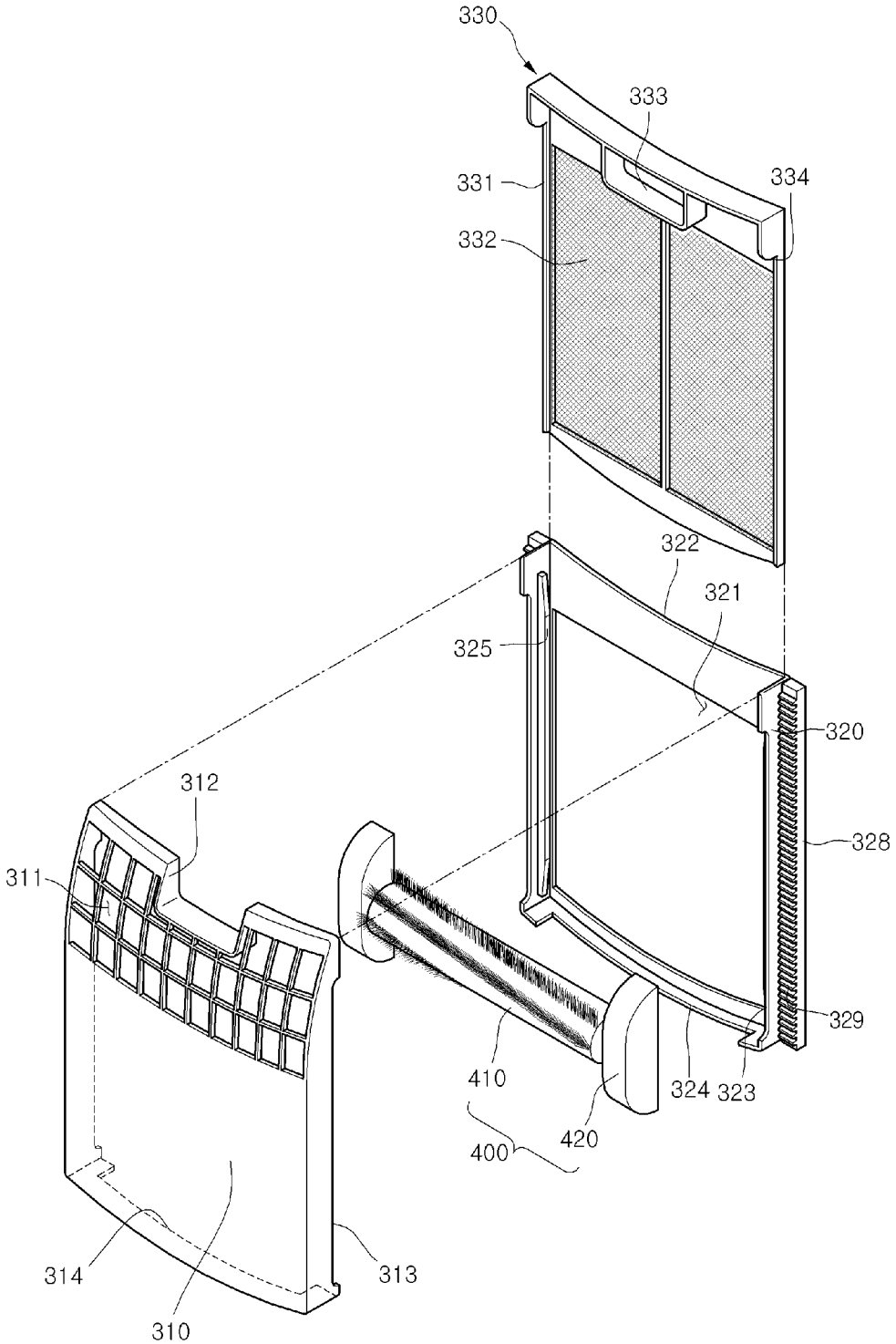
FIG. 4 is an exploded perspective view showing internal components of a foreign material removing apparatus according to a first embodiment.
Figure 5:
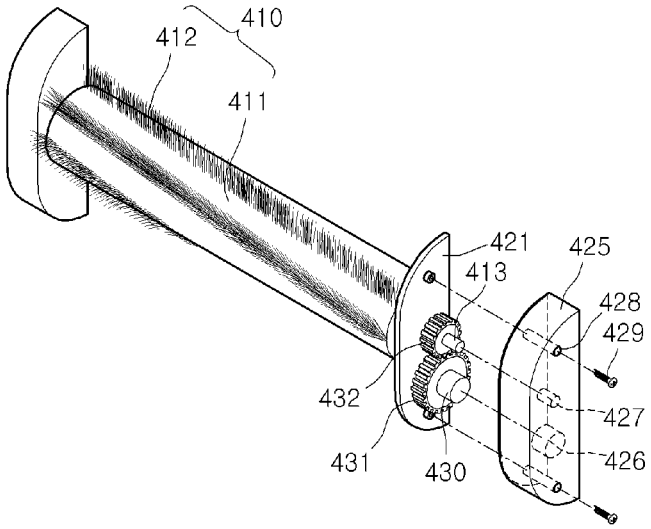
FIG. 5 is a diagram showing internal components of a cleaning unit and a driver of FIG. 4.
Figure 6:
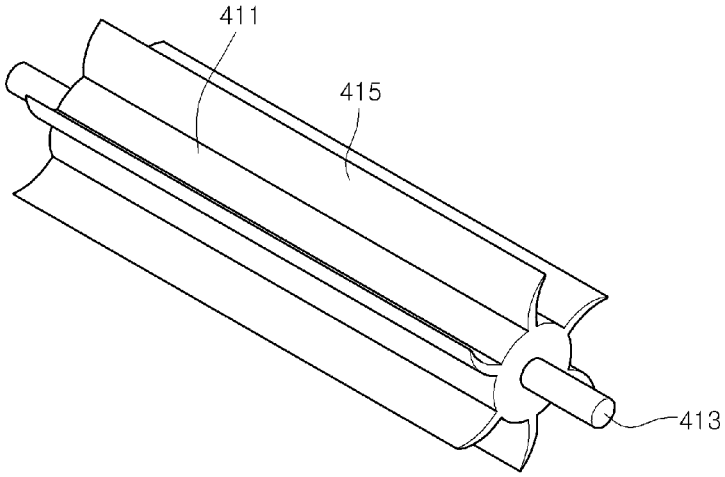
FIG. 6 is a diagram showing a cleaning device according to a second embodiment.

FIG. 3 is a perspective view of a foreign material removing apparatus and a foreign material case according to a first embodiment, FIG. 4 is an exploded perspective view showing internal components of a foreign material removing apparatus according to a first embodiment, FIG. 5 is a diagram showing internal components of a cleaning unit and a driver of FIG. 4, and FIG. 6 is a diagram showing a cleaning device according to a second embodiment.

Referring to FIGS. 3 to 6, the foreign material removing apparatus 300 includes a first case 310 with an air introduction hole 311, a second case 320 with an air discharge hole 321, a filtering unit 330 provided in a space between the first case 310 and the second case 320, which filters foreign materials introduced through the air introduction hole 311, and a cleaning unit 400 for removing the foreign materials filtered by the filtering unit 330.

At this time, the first case 310 and the second case 320 may be integrally inject-molded. Further, the positions of the air introduction hole 311 and the air discharge hole 321 are variable. It will be understood that the modification is design modification easily implemented by those skilled in the art and is within the spirit of the embodiment.

Herein, the foreign material removing apparatus 300 is inserted into the drum cover 210 while the first case 310 faces the rear side and the second case 320 faces the front side. That is, the first case 310 faces the rear side so as to smoothly introduced the air discharged from the drum 200 into the air introduction hole 311 through the air duct 215.

More specifically, the air introduction hole 311 as a passage through which the air discharged from the drum 200 is introduced is inclined at a predetermined angle so as to introduce the air discharged from the drum 200 into the upper portion of the first case 310 at an acute angle. The air introduction hole 311 is included to allow the air discharged from the drum 200 to obliquely pass through the filtering unit 330. Therefore, a filtering function in the filtering unit 330 may be better performed. Moreover, the air introduction hole 311 has a grill shape to prevent the drying target from being introduced into the foreign material removing apparatus 300.

In addition, a groove 314 defining a portion of the foreign material discharge hole 360 for the foreign materials discharged after being separated from the filtering unit 330 is formed on the bottom surface of the first case 310.

A first guide groove 313 guiding movement of a cleaning device 410 to be described below is formed in the first case 310 so that the cleaning device 410 vertically translates. The first guide groove 313 defines a complete guide groove 350 together with a second guide groove 323 to be described below. In the embodiment, the guide groove 350 may be referred to as a guide part.

In addition, a handle groove 312 that allows the user to easily grip a handle 333 of the filtering unit 330 may be formed in an upper end portion of the first case 310.

Meanwhile, the air discharge hole 321 formed in the second case 320 has a substantially rectangular shape, but the shape of the air discharge hole 321 is not limited. The air discharge hole 321 preferably has a size enough to secure the quantity of wind that circulates in the dryer 10.

In addition, a fixation rib 325 is provided on each of both sides of the second case 320 so that the filtering unit 330 is coupled to a precision position. The fixation ribs 325 extend to be close to each other. In addition, the fixation rib 325 is spaced from a surface 322 on which the air discharge hole 321 is formed. Therefore, the filtering unit 330 is positioned between the fixation rib 325 and the surface 322 on which the air discharge hole 321 is formed.

The top surface of the second case 320 is opened so that the filtering unit 330 is inserted into the second case 320 from the top. That is, the filtering unit 330 is housed between the fixation rib 325 and the surface 322 to the bottom from the top.

A second guide groove 323 formed to correspond to the first guide groove 313 is provided at both sides of the second case 320. The first guide groove 313 and the second guide groove 323 forms the complete guide groove 350. The cleaning device 410 moves vertically along the guide groove 350.

A groove 324 that is formed at a position corresponding to the groove 314 of the first case 310 and defines the other portions of the foreign material discharge hole 360 are formed on the bottom surface of the second case 320.

A guide part 328 guiding the driver 420 of the cleaning unit 400 to translate vertically is provided outside of the both sides of the second case 320.

That is to say, the air introduction hole 311 is formed on one side and the air discharge hole 321 is formed on the other side of the foreign material removing apparatus 300 formed by coupling the first case 310 and the second case 320 with each other. In addition, the top surface of the foreign material removing apparatus 300 is opened so that the filtering unit 330 is inserted into the foreign-removing device 300 and the foreign material discharge hole 360 is formed on the bottom surface of the foreign material removing apparatus 300. That is, the air introduced through the air introduction hole 311 is filtered while passing through the filtering unit 330 and discharged through the air discharge hole 321. In addition, the foreign materials filtered by the filtering unit 330 are discharged through the foreign material discharge hole 360 and thereafter, stored in the foreign material case 390.

Meanwhile, the filtering unit 330 includes a filter case 331 and a filter 332 that is supported on the filter case 331 and filters the foreign materials in the air.

More specifically, the handle 333 is provided at an upper end portion of the filter case 331. The handle 333 is positioned at the handle groove 312 when the filter case 331 is mounted on the second case 320.

A hook part 334 is formed at an upper portion of the filter case 331 so that the filtering unit 330 is coupled to the second case 320 and stably fixed. The hook part 334 is positioned on an upper portion of the fixation rib 325.

Meanwhile, the foreign materials filtered by the filtering unit 330 are removed by the cleaning unit 400 and the removed foreign materials are discharged to the foreign material case 390 through the foreign material discharge hole 360.

The cleaning unit 400 includes the cleaning device 410 removing the foreign materials accumulated in the filter 332 and a driver a driving device 430 for moving the cleaning device 410.

More specifically, the cleaning device 410 includes a rotation body 411 disposed in a direction crossing a movement direction of the cleaning device 410 and a brush 412 disposed on an exterior surface of the rotation body 411 in a direction in which the rotation body 411 extends.

The brush 412 contacts with the filter 332 while the rotation body 411 rotates to remove the foreign materials accumulated in the filter 332.

The plurality of brushes 412 may be provided on the periphery of the rotation body 411. Each of the brushes 412 may have a spiral shape so that a position of the brush 412 at one end portion and a position of the brush 412 at the other end portion of the rotation body 411 are different from each other.

When the brush 412 has the spiral shape, the foreign materials can be continuously from one end portion to the other end portion of the brush 412. Therefore, it is possible to clean the filter 332 more cleanly. In addition, a rotation shaft 413 extends to both sides of the rotation body 411.

The driver 420 is provided at both sides of the cleaning device 410. The driver 420 includes the driving device 430, a first gear 431 connected to the driving device 430, and a second gear 432 that is coupled to the rotation shaft 411 and engages in the first gear 431. At this time, as the driving device 430, the motor may be used. In addition, the motor is a bidirectionally rotatable motor.

Further, the driver 420 includes an inner case 421 and an outer case 425 that protect the driving device 430, etc.

The inner case 421 has a plate shape and penetrated by the rotation shaft 413. In addition, the rotation shaft 413 penetrating the inner case 421 is coupled with the second gear 432. Unlike this, a gear shaft of the second gear 432 may be coupled to the rotation body 411 by penetrating the inner case 421.

A space housing the driving device 430, etc. is provided in the outer case 425. More specifically, a driving device supporting part 426 supporting the driving device 430 and a rotation shaft supporting part 427 supporting the rotation shaft 413 are provided in an inner space of the outer case 425. The outer case 425 and the inner case 421 are coupled with each other by, for example, a screw 429.

When the driving device 430 is driven, the cleaning device 410 rotates and the brush 412 rotates in close contact with the filter 332 to remove the foreign materials filtered by the filter 332.

Referring to FIG. 6, a projection part 415 having a predetermined shape may be provided in the rotation body 411 unlike the brush 412. The projection part 415 extends in a rotation axis direction of the rotation body 411 and an end portion of the projection part 415 is in close contact with the filter 332. At this time, the projection part 415 may be bent at a predetermined curvature.

The projection part 415 may be made of an elastic material so as to prevent the filter 332 from being damaged.

Referring back to FIG. 4, a rack gear 329 is formed on a surface of the guide part 328 facing the first case 310. In addition, the first gear 431 engages in the rack gear 329.

A portion of the first gear 431 is projected to the outside of the outer cases 421 and 425 to engage in the rack gear 329. Therefore, when the driving device 430 is driven, the cleaning unit 400 moves upwards or downwards along the rack gear 329 by the interaction between the first gear 431 and the rack gear 329.

In the embodiment, the cleaning unit moves vertically along the rack gear, but on the contrary, the rack gear is disposed in a horizontal direction of the foreign material removing apparatus, such that the cleaning unit may move horizontally. It will be understood that the modification is design modification easily implemented by those skilled in the art and is within the spirit of the embodiment.

Figure 7:
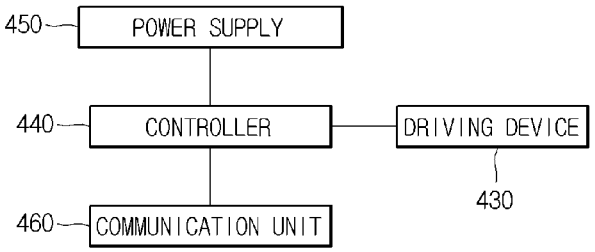
FIG. 7 is a block diagram showing control components of a foreign material removing apparatus according to an embodiment of the present invention.

FIG. 7 is a block diagram showing control components of a foreign material removing apparatus according to an embodiment of the present invention.

Referring to FIG. 7, the foreign material removing apparatus 300 includes a power supply 450 for supplying power to the driving device 430, a controller 440 for controlling the driving device 430, and a communication unit 460 communicating with the a controller (not shown) of the dryer 10. A battery may be used as the power supply 450 as an example. In addition, the controller 440 controls on/off and a rotation direction of the driving device by using information acquired by the communication unit 460. For example, when the dryer operates or the dryer stops, the controller allows the driving device 430 to operate.

Of course, when a synchronous motor is used as the driving device 430, a rotation direction of the motor is automatically changed by external force. Therefore, the controller 440 controls the on/off of the driving device.

The power supply 450, the controller 440, and the communication unit 460 may be positioned in a space between the inner case 421 and the outer case 425.

An operation of the foreign material removing apparatus will be described.

Figure 8:
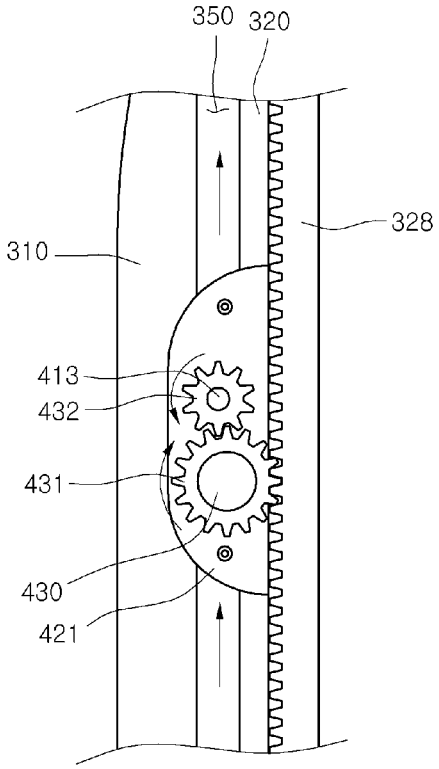
FIG. 8 is a diagram showing a state in which a driver of a cleaning unit of FIG. 3 operates.
Figure 9:
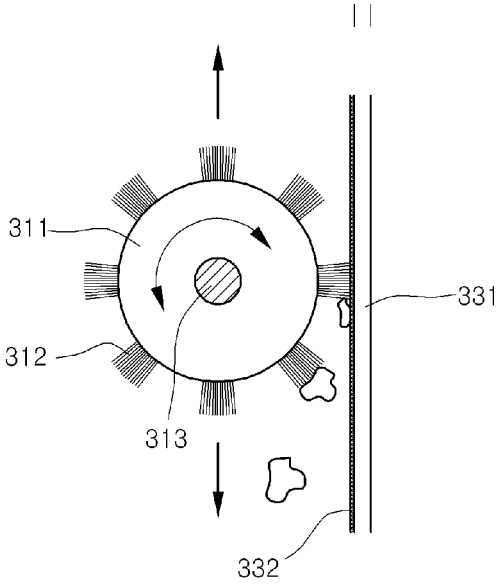
FIG. 9 is a diagram showing a state in which foreign materials are removed in a filter by a cleaning unit of FIG. 3.

FIG. 8 is a diagram showing a state in which a driver of a cleaning unit of FIG. 3 operates and FIG. 9 is a diagram showing a state in which foreign materials are removed in a filter by a cleaning unit of FIG. 3.

Referring to FIGS. 8 and 9, when the driving device 430 is operated by the controller 440, the first gear 431 rotates in one direction (i.e., clockwise direction). When the first gear 431 rotates in one direction, the second gear 432 rotates in an opposite direction (i.e., counterclockwise direction) to the first gear 431.

Then, the cleaning unit 400 rises and the cleaning device 410 rotates in the counter-clockwise direction to remove the foreign materials of the filter 322. At this time, since the cleaning device 410 translates and rotates at the same time, together, the foreign materials of the filter 322 can be effectively removed. At this time, the rotation shaft 413 moves along the guide groove 350.

When the cleaning unit 400 does not rise any longer, the controller 440 controls the driving device, such that the cleaning unit 400 falls. In the embodiment, for example, it is determined whether or not the cleaning unit 400 reaches a position where the cleaning unit 400 cannot rise by using current sensed by a current sensor not shown. That is, when the cleaning unit reaches the position where the cleaning unit 400 does not rise any longer, the current sensed by the current sensor increases. Therefore, the controller can control the operation of the driving device 430 by using current information. Of course, when the synchronous motor is used, the rotation direction of the motor is automatically changed by applying resistance force equal to or less than resistance force set to the motor itself. In this case, the current sensor is not required.

The first gear 431 rotates in the counterclockwise direction, such that the cleaning unit 400 falls. When the first gear 431 rotates in the counterclockwise direction, the second gear 432 rotates in an opposite direction (i.e., clockwise direction) to the first gear 431.

Meanwhile, the foreign materials removed from the filter 322 by the cleaning device 410 falls downwards by gravity.

The foreign materials that fall downwards are stored in the foreign material case 390 by passing through the foreign material discharge hole 360.

By the embodiment, since the foreign materials accumulated in the filter 322 are automatically accumulated, a problem in that the user separates the foreign material removing apparatus from the dryer to clean the filter is removed.

Further, when the foreign materials are stored in the foreign material case 390 at a predetermined level or more without cleaning the filter 332 whenever using the dryer 10, since the user just separates only the foreign material case 390 to remove the foreign materials, such that user convenience is maximized.

Further, in the case where the filter 332 is automatically cleaned, the wind quantity passing through the inside of the drum 220 is maintained at predetermined level or more, thereby reducing a risk of firing.

Figure 10:
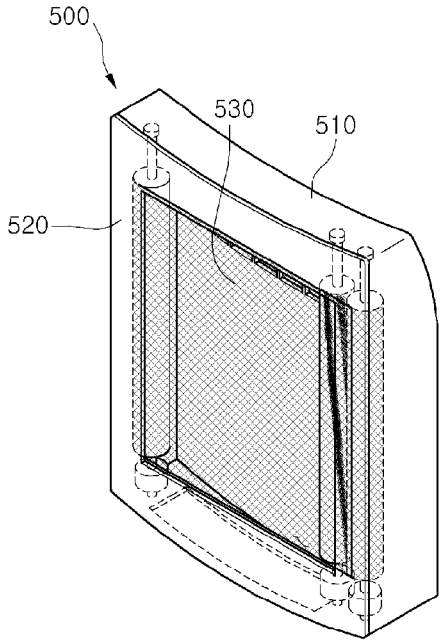
FIG. 10 is a perspective view of a foreign material removing apparatus according to a third embodiment.
Figure 11:
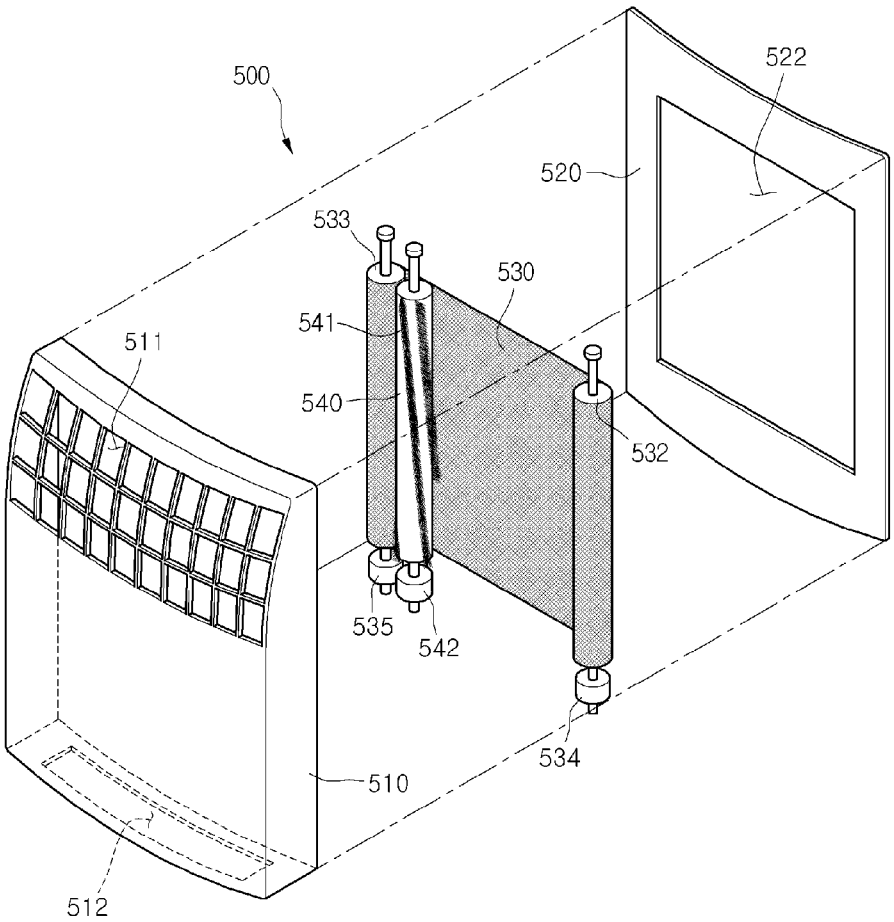
FIG. 11 is an exploded perspective view of a foreign material removing apparatus according to a third embodiment.

FIG. 10 is a perspective view of a foreign material removing apparatus according to a third embodiment and FIG. 11 is an exploded perspective view of a foreign material removing apparatus according to a third embodiment.

Most elements of the embodiment are the same as those of the first embodiment. However, the embodiment is different from the first embodiment in the structure of the foreign material removing apparatus. Therefore, hereinafter, only a peculiar part of the embodiment will be described.

Referring to FIGS. 10 to 11, the foreign material removing apparatus 500 includes a first case 510 with an air introduction hole 511, a second case 520 with an air discharge hole 522, a filtering unit provided in a space between the first case 510 and the second case 520, and a cleaning unit for cleaning the filtering unit.

More specifically, a foreign material discharge hole 512 for discharging the foreign materials removed from the filtering unit is formed in the first case 510.

The filtering unit includes a filter 530 for removing the foreign materials in the air, a plurality of rollers 532 and 533 on which the filter is wound, and a plurality of motors 534 and 535 for rotating each roller. When the plurality of rollers 532 and 533 are spaced from each other, the plurality of rollers extend, for example, vertically. In addition, when the motors 534 and 535 operate, the rollers 532 and 533 rotate in the same rotation direction at the same speed.

When the plurality of rollers 532 and 533 rotate, the filter 530 is wound on any one roller and the filter 530 is released in the other roller. That is, the filter 530 is movable in the case.

At this time, the filter 530 may be made of a soft material, such that the filter 530 is wound on the rollers 532 and 533.

In addition, the filter 530 at least covers a plane where the air discharge part 522 is formed. If a portion of the air discharge part 522 is not covered by the filter 530, the air passes through the filter 530 in a state where the foreign materials are not filtered.

The cleaning unit includes a cleaning device 540 and a motor 542 rotating the cleaning device 540. A brush 541 is provided on the peripheral surface of the cleaning device 540. The cleaning device 540 has a cylindrical shape. In addition, an extension direction of the cleaning device 540 crosses the movement direction of the filter 530.

In addition, the cleaning device 540 is disposed adjacent to any one roller 533. In FIG. 11, the cleaning device 540 is disposed between the plurality of roller 532 and 533, but the cleaning device 540 may be positioned at an opposite side of any one roller on the basis of the filter 530.

In addition, when at least one outer surface of the cleaning device 540 is in contact with the filter 530 and is rotatably supported on the foreign material removing apparatus, the cleaning device 540 may rotate without the motor 542 by friction force.

Hereinafter, an operation of the foreign material removing apparatus 500 will be described.

The air containing the foreign materials discharged from the drum 200 is introduced into the foreign material removing apparatus 500 through the air introduction hole 511. After the air passes through the air introduction hole 511, the foreign materials are filtered while the air passes through the filter 530. The air filtered through the filter 530 is discharged to the outside of the foreign material removing apparatus 500 through the air discharge hole 522. When the operation is continuously performed, the foreign materials are accumulated in the filter 530 enough to pass the air. Then, in this state, the foreign materials attached to the filter 530 should be removed.

At this time, the filter 530 moves from the first roller 532 to the second roller 533 by rotating the rollers 532 and 533 as an example. That is, the first roller 532 is rotated in a direction to release the filter 530 and the second roller 533 is rotated in a direction to wind the filter 530. While the rollers 532 and 533 rotate, the cleaning device 540 rotates. Then, the cleaning device 540 shakes off the foreign materials attached to the filter 530. The foreign materials that shake off are received in the foreign material case 390 through the foreign material discharge hole 512.

While the filter 530 moves by rotating the rollers 532 and 533, the operation of removing the foreign materials by the cleaning device 540 may be performed regardless of the operation of the dryer. However, preferably, the circulation fan 222 stops to prevent the air from being circulated, such that the foreign materials separated from the filter 530 do not move to the filter 530 again.

In addition, after all the foreign materials move to the rollers 532 and 533, separation of the foreign materials by the cleaning device 540 is actually terminated. Therefore, the rollers 532 and 533 and the cleaning device 540 may stop to operate. At this time, since a new filter 530 corresponds to the air discharge hole 522, there is no problem in the filtering operation. Of course, the separation operation may be repetitively performed at several times by reversely rotating the roller.

As a modified example of the embodiment, when the foreign materials filtered by the filter 530 firmly adhere to the filter 530, the foreign materials are not small materials but have a lump shape. Therefore, in this case, since the foreign materials removed by the cleaning device 540 fall through the foreign material discharge hole 512 without actually being influenced due to flow of fluid by the circulation fan 222 even though the circulation fan 222 operates, there is no problem. Of course, if a problem that the foreign materials are discharged through the air discharge hole 522 is solved or only a problem relating to introduction of the foreign materials into the circulation fan is solved, the foreign materials may be separated from the filter 530 by operating the rollers 532 and 533 and the cleaning device 540 even though the circulation fan operates. In this case, the foreign materials that falls while being separated from the filter 530 repetitively fall through the foreign material discharge hole 512 even little by little, such that the filter 530 is cleaned.

As another modified embodiment, all the motors 534, 535, and 542 adopted in the embodiment are not essentially provided and the rollers 532 and 533 and the cleaning device 540 rotate by a single or more motors or external another power sources by means of a power transmission device.

Figure 12:
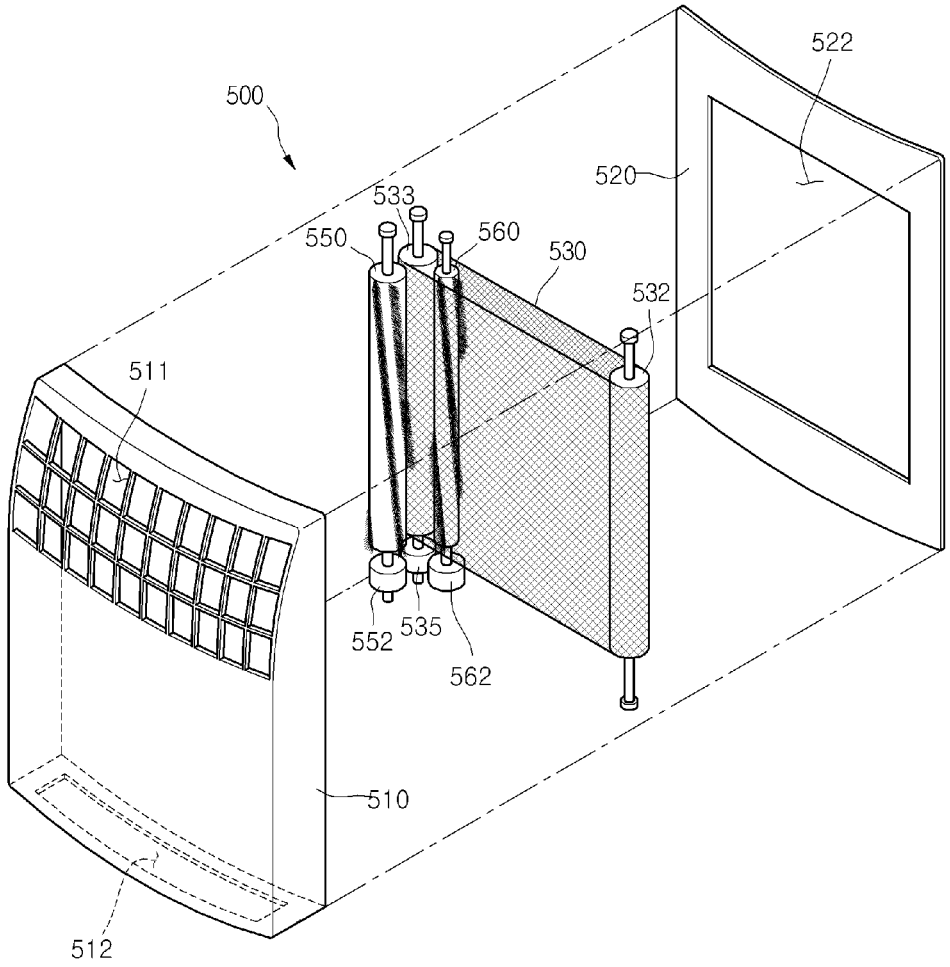
FIG. 12 is an exploded perspective view of a foreign material removing apparatus according to a fourth embodiment.

FIG. 12 is an exploded perspective view of a foreign material removing apparatus according to a fourth embodiment.

Most elements of the embodiment are the same as those of the third embodiment. However, the embodiment is different from the third embodiment in the structures of the filtering unit and the cleaning unit. Therefore, hereinafter, only specific elements of the embodiment will be described and the same elements as the third embodiment refer to the descriptions and reference numerals of the third embodiment.

Referring to FIG. 12, the filter 530 of the embodiment surrounds the plurality of rollers 532 and 533 while form a loop.

Accordingly, the filter 530 is pulled by the rollers 532 and 533, such that predetermined tension is generated and the filter 530 is also rotatably by a rotation motion of any one roller.

In this case, a filtering surface generated by the filter 530 includes two surfaces such as a front surface and a rear surface on the basis of FIG. 12, thereby acquiring a higher foreign material filtering effect. However, like the third embodiment, when two surfaces serve as the filtering surface, an outer surface of the filter passing through the front side of the figure serves as the filtering surface, while an inner surface of the filter passing through the rear side of the figure serves as the filtering surface. Therefore, a cleaning device that separates the filtered foreign materials is provided on each of the outer surface and the inner surface.

More specifically, the cleaning unit according to the embodiment includes a first cleaning device 550 for cleaning the outer surface of the filter 530 and a second cleaning device 560 for cleaning the inner surface of the filter 530. In addition, each of the cleaning devices 550 and 560 may be rotated by motors 552 and 562. Further, the diameter of the second cleaning device 560 may be smaller than those of the rollers 532 and 533.

In the embodiment, since a double-layer filter performs the filtering operation, the filtering efficiency of the foreign materials is improved. Moreover, since the foreign materials on the inner surface and the outer surface of the filter are removed by two cleaning devices, the foreign materials are removed from the filter more rapidly and the foreign material removing efficiency is improved.

Figure 13:
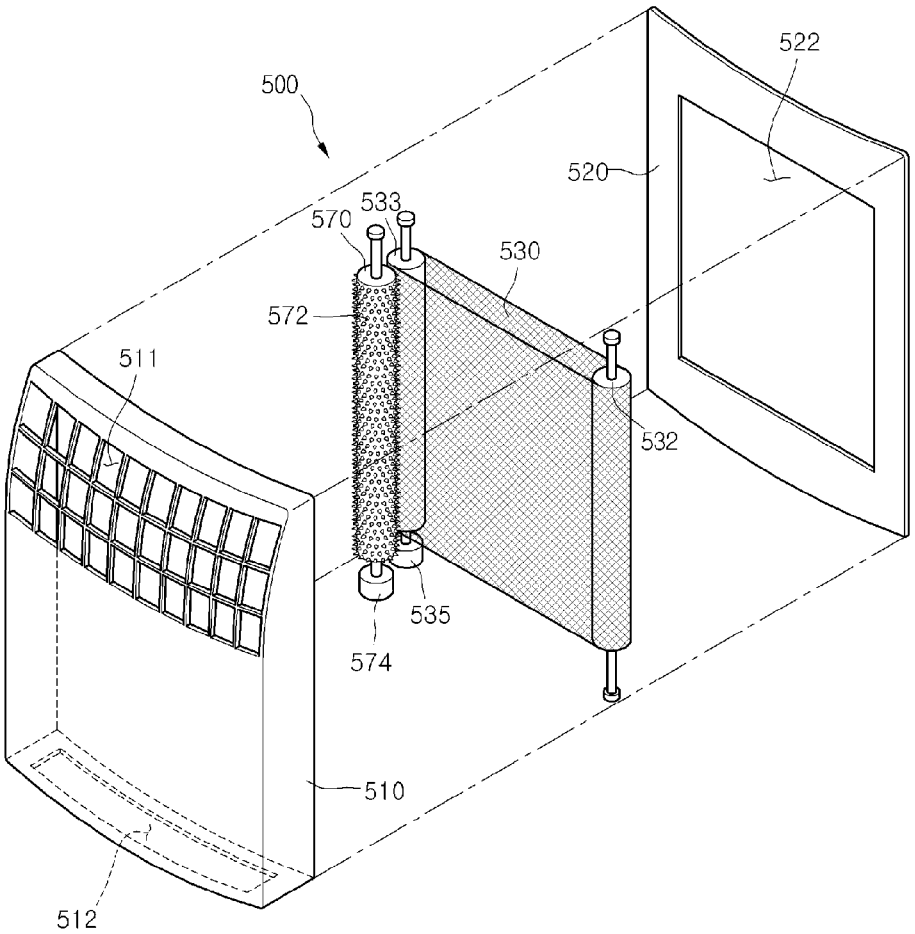
FIG. 13 is an exploded perspective view of a foreign material removing apparatus according to a fifth embodiment.

FIG. 13 is an exploded perspective view of a foreign material removing apparatus according to a fifth embodiment.

Referring to FIG. 13, the fifth embodiment is the same as the fourth embodiment in that the filter 530 is wound on the rollers 532 and 533. However, the fifth embodiment is different from the fourth embodiment in that no brush is provided in the cleaning device 570 and a plurality of projection parts 572 are formed.

This has an object for crushing and removing the foreign materials that adhere onto the outer surface of the filter 530.

When the dryer operates, only a soft material exemplified as fabric lint is not generated as the foreign materials, but materials having viscosity, such as detergent wastes, dying fabric dyes, etc. are also generated. Further, the fabric naps include slightly large naps, but on the contrary, the fabric naps include large naps, such that the naps are entangled in each other. When the materials filtered by the filter 530 are entangled in each other, the materials are consequently changed into hard and strong solid materials. The detergent wastes serve as a cohesive agent and the naps are entangled in each other due to different sizes.

Since the solid material has some-degree strength, the material may not be removed by using only the brush. In this case, it is necessary to once crush and remove the solid material. For this, the plurality of projection parts 572 are adopted to crush the solid material including at least lint as one component.

In the cleaning device 570, the plurality of projection parts 572 crushes the solid material through strong pressing and lifts up the solid material with the projection part 572 stuck in the cleaning device 570. By lifting up the solid material, the solid material is once separated from the filter 530 and by the next projection part, the solid material may be crushed or separated from the filter again.

Figure 14:
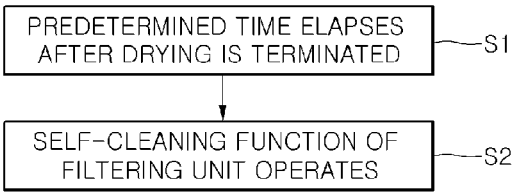
FIG. 14 is a flowchart describing a method for separating foreign materials according to a fifth embodiment.

FIG. 14 is a flowchart describing a method for separating foreign materials according to a fifth embodiment.

Referring to FIG. 14, the foreign materials are continuously filtered by the filter 530 while the dryer operates. Of course, at this time, the detergent wastes, dye wastes, etc are filtered in addition to the lint. In this case, in a general case, if the filter 530 is not excessively small, the foreign materials are not filtered enough to disable the filter 530 to perform its own function by a one-time operation of the dryer. However, after the dryer operates once, the foreign materials filtered by the filter may be solidified to be changed into the storing solid material.

According to the embodiment, a drying process of the dryer is terminated and thereafter, it is waited that the filtered material will be solidified for a predetermined time (S1). After the predetermined time elapses, the filtered material is hard and solidified. Therefore, the filtered material can be properly removed by the cleaning device 570. At this time, a self-cleaning function of the filtering unit operates (S2). At this time, a series of processes are performed in describing the operation of the embodiment.

According to the embodiment, since the foreign materials adhere to the filter, the foreign materials may be separated at a time in a state where the foreign materials adhere to each other without adhering to the filter even when the foreign materials are detached from the filter. Therefore, the foreign materials can be removed from the filter more clearly.

A modified example of the embodiment is disclosed. A cleaning device of which an outer peripheral surfaced includes a projection part adopted in the embodiment may be adaptively used in the case of crushing and removing the hard solid material. The brush adopted in the third embodiment and the fourth embodiment may be adaptively used in the case of shaking off and removing some-degree soft lint which is yet not solidified hard. This may be fairly changed depending on a local area or a nation, user' use habits, etc. and in order to adaptively deal with it, a structure in which both the brush and the projection part are adopted in a single cleaning device or an embodiment including a cleaning device with the brush and a cleaning device with the projection part may be considered and may be also included within the spirit of the embodiment.

In addition, in the embodiments described above, since the brush or the projection part is a component that removes (separates) the foreign materials of the filter, they will be able to be commonly referred to as a foreign material removing unit.

The invention claimed is:

1. A dryer, comprising:
- a cabinet;
- a drum in the cabinet and housing a drying target;
- a case including an air introduction hole into which air discharged from the drum is introduced, an air discharge hole, and a foreign material discharge hole;
- a rack gear protruded from two sides of the case;
- a filtering unit in the case and including a filter;
- a cleaning device that moves relatively to the filter and removes foreign materials accumulated in the filter, the cleaning device including a rotation member to be rotatable and a cleaning member on the rotation member; and
- a pair of drivers at two sides of the cleaning device to rotate the cleaning device, the drivers including:
  - a motor;
  - a first gear connected to the motor and having a tooth communicating with the rack gear; and
  - a second gear having a gear tooth communicating with the tooth of the first gear and connected to the rotation member,
  - wherein the first gear and the second gear contact each other and rotate when the motor operates.

2. The dryer of claim 1, wherein the filtering unit is drawn out to an outside of the case.

3. The dryer of claim 1, further comprising:
- a foreign material case under the foreign material discharge hole and storing discharged foreign materials.

4. The dryer of claim 1, further comprising:
- a driver case covering the motor.

5. The dryer of claim 4, wherein the driver case comprises an inner case coupled to the rotation member and an outer case coupled to the inner case.

6. The dryer of claim 5, further comprising a rotation shaft extending from the rotation member and passing through the inner case.

7. The dryer of claim 5, wherein the first gear and the second gear are at the inner case.

8. The dryer of claim 5, wherein the motor is in a space defined by the inner and the outer case.

9. The dryer of claim 1, wherein the case includes a guide hole at two sides of the case receiving a driver case.

* * * * *